US008549669B2

(12) United States Patent
Kronenbeger

(10) Patent No.: US 8,549,669 B2
(45) Date of Patent: Oct. 8, 2013

(54) ENHANCED HEADWEAR PACKAGE

(76) Inventor: Ronald Kronenbeger, Riverwoods, IL (US)

( * ) Notice: Subject to any disclaimer, the term of this patent is extended or adjusted under 35 U.S.C. 154(b) by 1634 days.

(21) Appl. No.: 10/910,680

(22) Filed: Aug. 3, 2004

(65) Prior Publication Data

US 2006/0026739 A1 Feb. 9, 2006

(51) Int. Cl.
*A42B 1/24* (2006.01)

(52) U.S. Cl.
USPC ..... 2/209.13; 2/195.1

(58) Field of Classification Search
USPC ..... 2/209.13, 195.1; 40/661.04; 705/20; D20/43
See application file for complete search history.

(56) References Cited

U.S. PATENT DOCUMENTS

| | | | | | |
|---|---|---|---|---|---|
| 25,750 | A * | 10/1859 | McDougall | 40/661.04 |
| 162,565 | A * | 4/1875 | LeRoy et al. | 40/661.04 |
| 261,117 | A * | 7/1882 | Spahmer | 40/329 |
| 270,242 | A * | 1/1883 | Mitchell | 297/393 |
| 292,049 | A * | 1/1884 | Reitmeyer | 2/209.13 |
| 1,163,054 | A * | 12/1915 | Williams | 2/10 |
| 2,771,230 | A * | 11/1956 | Fitzpatrick | 224/254 |
| D202,973 | S * | 11/1965 | Field | D20/27 |
| 4,406,296 | A * | 9/1983 | Wexler et al. | 132/148 |
| 5,031,812 | A * | 7/1991 | Gustine | 224/191 |
| 5,898,946 | A * | 5/1999 | Keating et al. | 2/209.13 |
| 6,094,749 | A * | 8/2000 | Proctor | 2/195.2 |
| 6,226,905 | B1 * | 5/2001 | Osuna | 40/1.6 |
| 6,317,934 | B1 * | 11/2001 | Hiroki et al. | 24/16 PB |
| 2001/0042009 | A1 * | 11/2001 | Montague | 705/14 |
| 2002/0095844 | A1 * | 7/2002 | Slavik | 40/666 |
| 2002/0108189 | A1 * | 8/2002 | Kahl | 8/445 |

* cited by examiner

*Primary Examiner* — Richale Quinn
(74) *Attorney, Agent, or Firm* — Wood, Phillips, Katz, Clark & Mortimer

(57) ABSTRACT

The combination of a headwear piece, at least one object, and a tether. The headwear piece has a crown with a surface for engaging a wearer's head to maintain the headwear piece in an operative position on the wearer's head. The at least one object has an identification thereon that relates to at least one of: a) an event; b) a location; c) an institution; d) a product; e) a service; f) a person; g) an animate object; h) an inanimate object; i) a team; and j) a participant in an event. The tether maintains the at least one object on the headwear piece. An identification on the headwear piece is coordinated with the identification on the at least one object.

3 Claims, 5 Drawing Sheets

ENHANCED HEADWEAR PACKAGE

BACKGROUND OF THE INVENTION

1. Field of the Invention

This invention relates to headwear and, more particularly, to the combination of a headwear piece and an object releasably attached thereto through a tether arrangement.

2. Background Art

The competition for headwear sales continues to increase. Caps and hats are offered by vendors as souvenirs at an ever growing number of events, such as team competitions, including both those that are athletic and academic in nature, golf tournaments, car races, etc. Virtually every venue at which there is some form of competition offers an opportunity for headwear sales. Opportunities for headwear sales exist in many other venues, at which headwear is offered for advertising and/or commemorative purposes.

Because of the extreme competition for these sales, purveyors of headwear continue to seek new designs that will gain the attention of event coordinators and ultimately the base of end purchasers. This challenge to headwear designers has led to a multitude of different ornamentation. The majority of this ornamentation is permanently attached and ranges from two dimensional applications through coloration, stitching and patch application, to attachment of three-dimensional components. The assignee herein has also devised a two-dimensional design scheme that simulates a three-dimensional appearance. It is also known to apply decorative pins and other components directly to the headwear pieces. For example, it is known to magnetically attach divot repair tools and ball marks to headwear designed for use by golfers. This type of headwear is designed primarily to enhance its functional attributes and is generally targeted at golfers rather than souvenir hunters.

In spite of enormous design and marketing efforts made by those in the headwear industry, the industry overall has not effectively exploited headwear as a platform to offer other commemorative items. The industry has failed to recognize that a basic headwear piece, packaged in a certain manner, as for example with an additional commemorative item, could effectively and favorably distinguish the combined package from competitors' headwear products in the minds of the target audience. As a result, heretofore, headwear designers have relied on novel arrangements of color, design, etc. on headwear to attract the attention of purchasers away from headwear offered by their competitors. Since the appeal of the particular ornamentation on a headwear piece is not universal and its acceptance may often be "hit or miss" based upon individual preference, headwear pieces offered by different headwear manufacturers rarely stand out by reasons of this ornamentation and often are viewed as somewhat generic in nature by consumers.

The industry continues to seek out new headwear designs and packages that distinguish from well recognized designs to offer a unique lure to both an existing customer base and potentially a new base of customers.

SUMMARY OF THE INVENTION

In one form, the invention is directed to the combination of a headwear piece, at least one object, and a tether. The headwear piece has a crown with a surface for engaging a wearer's head to maintain the headwear piece in an operative position on the wearer's head. The at least one object has an identification thereon that relates to at least one of: a) an event; b) a location; c) an institution; d) a product; e) a service; f) a person; g) an animate object; h) an inanimate object; i) a team; and j) a participant in an event. The at least one object is either a functional item or a replica of a functional item. The tether maintains the at least one object on the headwear piece. An identification on the headwear piece is coordinated with the identification on the at least one object.

The at least one object may be a yardage book for a golf course.

The at least one object may be a key chain.

In another form, the at least one object is in the form of a scorecard for an athletic event, such as for a particular golf course to which the identification on the headwear piece relates.

In one form, the at least one object is substantially smaller than the headwear piece.

The tether may include a flexible element that allows the at least one object to be repositioned relative to the headwear piece.

In one form, the tether has an elongate, non-metal element that can be broken by applying a moderate tensile force to the elongate, non-metal element.

The at least one object may be separable from the headwear piece by drawing the headwear piece and object away from each other with a moderate force.

The combination may further include a container for the at least one object and the tether connects between the container and the headwear piece.

The container may consist of an envelope defined by adjacent walls between which a receptacle for the at least one object is defined.

The at least one object may be an object designed to perform a specific function related to the identification on the headwear piece.

In one form, the at least one object includes at least a part of a ticket for an event.

The tether may be designed to permanently maintain the at least one object on the headwear piece.

The tether may be connected to the crown.

In one form, the headwear piece has a rim/bill and the tether is connected to the rim/bill.

The headwear piece may be in the form of a baseball-style cap.

In one form, the identification on the headwear piece relates to at least one of a) an event; b) a location; c) an institution; d) a product; e) a service; f) a person; g) an animate object; h) an inanimate object; i) a team; and j) a participant in an event.

The invention is further directed to the combination of headwear piece, at least one object, and a tether. The headwear piece has a crown with a surface for engaging a wearer's head to maintain the headwear piece in an operative position on the wearer's head. The at least one object is designed to perform a specific function or is a replica of an object that is designed to perform a specific function. The tether maintains the object on the headwear piece.

The combination may further include a container for the at least one object, with the tether connected between the container and the headwear piece.

The tether may include an elongate, non-metal element that can be broken by applying a moderate tensile force to the elongate, non-metal element.

In one form, the at least one object is separable from the headwear piece by drawing the headwear piece and object away from each other with a moderate force.

In one form, the container comprises an envelope defined by adjacent walls between which a receptacle for the at least one object is defined.

The at least one object may be a key chain.

In one form, at least one of the headwear piece and at least one object has an identification thereon that relates to at least one of a) an event; b) a location; c) an institution; d) a product; e) a service; f) a person; g) an animate object; h) an inanimate object; i) a team; and j) a participant in an event.

In one form, each of the headwear piece and at least one object has an identification thereon that relates to at least one of a) an event; b) a location; c) an institution; d) a product; e) a service; f) a person; g) an animate object; h) an inanimate object; i) a team; and j) a participant in an event.

The identification on the headwear piece and at least one object may be related to the same one of a) an event; b) a location; c) an institution; d) a product; e) a service; f) a person; g) an animate object; h) an inanimate object; i) a team; and j) a participant in an event.

The identification may relate to a golf event.

DETAILED DESCRIPTION OF THE DRAWINGS

Figure 1:
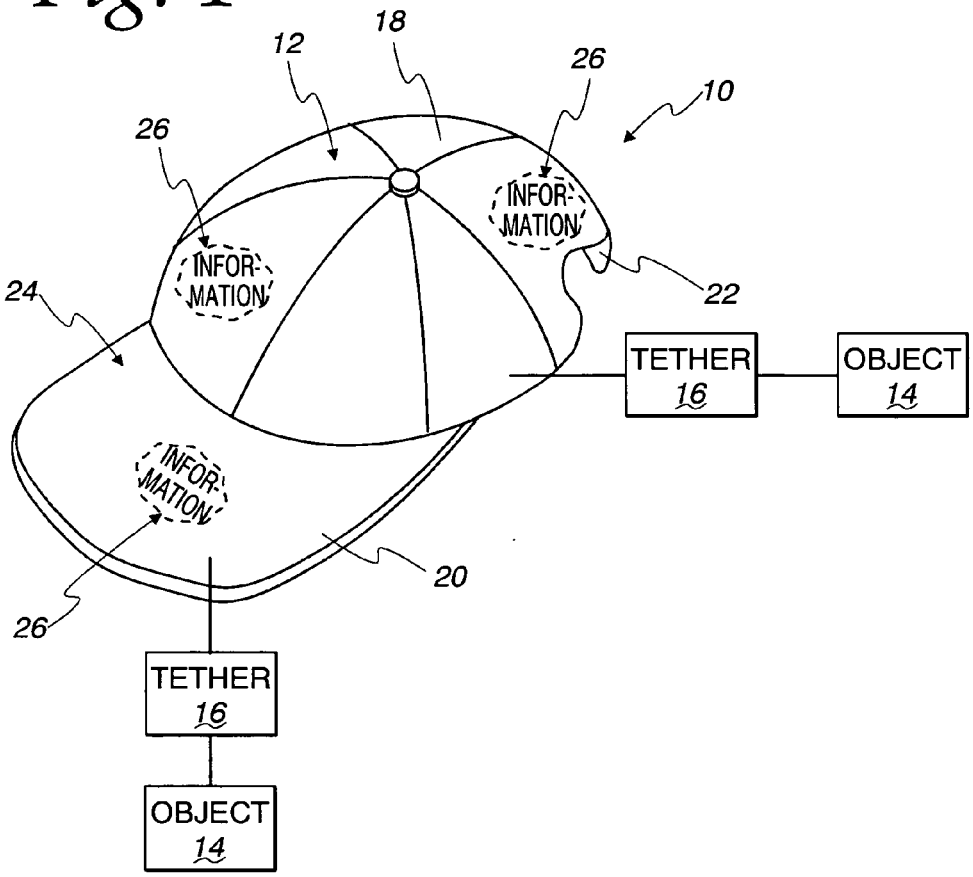
FIG. 1 is a partially schematic, perspective view of one form of kit/package, according to the present invention and including a headwear piece and separate objects maintained on the headwear piece through tethers.

In FIG. 1, a kit/package, according to the present invention, is shown at 10. The kit/package 10 consists of a headwear piece 12, an object 14, and a tether 16 through which the object 14 is maintained on the headwear piece.

As explained in greater detail below, the nature of the headwear piece 12 is not critical to the present invention. In this embodiment, the headwear piece 12 is in the form of baseball-style cap with a cup-shaped crown 18 having a rim/bill 20 projecting forwardly therefrom. The crown 18 has an inside surface 22 that engages a wearer's head so as to maintain the headwear piece 12 in an operative position on the wearer's head.

The headwear piece 12 has an exposed outer surface at 24 to which an identification, depicted ih the figures as "information", shown in a generic shape and with generic content at 26, is applied. The identification/information 26 may be in the form of words, identifiable colors, two- or three-dimensional shapes, logos, depictions of objects, persons, places, etc. that relate to at least one: a) an event; b) a location; c) an institution; d) a product; e) a service; f) a person; g) an animate object; h) an inanimate object; i) a team; and j) a participant in an event. For example, the identification/information 26 may relate to a competition such as a golf tournament, or one that involves other individual or team competition. The identification/information 26 may relate to someone or something in a non-competitive environment, or may be commemorative in nature, in the form of an advertisement or marketing, or provided for other purposes. In short, the subject of the identification/information 26 is virtually unlimited in nature. The identification/information 26 may be placed at any discrete location or locations on the headwear piece 12 or may be recognizable by a configuration, design, or color directly over a substantial portion, or the entirety, of the exposed outer surface 24. For example, a team may be recognizable by colors commonly used in association therewith. The three discrete locations for the identification/information 26 are intended only to be exemplary in nature.

The object 14 may also be diverse in nature and may be an authentic object, or a replica of an object. The object 14 may be an independently useful object made specifically to perform a clearly identifiable and intended independent function, that is not related to the construction of the headwear piece, such as a key chain, a nail clipper, a golf related tool, etc., that can be used by a wearer to assist in the performance of a task. The object 14 may be functional in relationship to the subject matter of the identification/information 26 on the headwear piece 12, such as a map for assisting the wearer in navigation around a location to which the identification/information 26 on the headwear piece 12 relates, etc. Alternatively, the object 14 may be primarily commemorative in nature without having a specific independent function. As a further alternative, the object 14 might be a two- or three-dimensional shape, that is essentially non-functional but relates to the identification/information 26 on the headwear piece 12 and is primarily commemorative in nature. For example, the object might be a three-dimensional replica of a car, with the identification/information 26 on the headwear piece relating to a car race.

Figure 2:
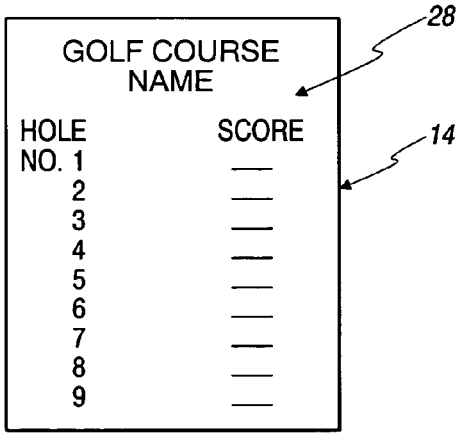
FIG. 2 is an elevation view of one form of object tethered to the headwear piece in FIG. 1 in the form of a golf scorecard.
Figure 3:
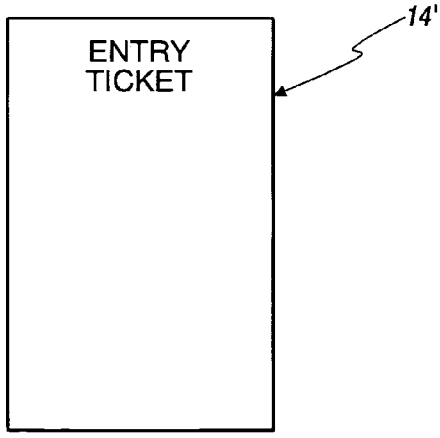
FIG. 3 is a view as in FIG. 2 of a modified form of object, in the form of a ticket for an event, that can be tethered to the headwear piece in FIG. 1.

Specific examples of objects are shown in FIGS. 2 and 3. In FIG. 2, the object 14 is shown as a scorecard or yardage booklet for a golf course. A yardage booklet is typically offered by golf courses as a useful aid to describe contours, distances, etc. relative to a particular golf course. The identification/information 26 may relate to a public or private course, or a course on which competitive golf tournaments are conducted. The scorecard/yardage booklet 14 may be for the particular golf course to which the identification/information 26 on the headwear piece 12 relates so as to provide a potentially useful tool for a golfer. The object might alternatively be a functional "bag tag" for a specific golf course. By coordinating identification/information 28 on the scorecard 14 with the identification/information 26 on the headwear piece 12, potentially a separate, valuable memento is afforded to the purchaser of the headwear piece 12.

Alternatively, as shown in FIG. 3, the functional object 14' may be an entry ticket required for entry to for an event to which the identification/information 26 on the headwear piece 12 relates. As an example, at a baseball venue, headwear purveyors may provide a baseball-style headwear piece 12 with one of the participating teams identified through the identification/information 26 thereon. The object 14' may be an actual ticket or a replica of a ticket for a game involving the subject team. The form of the ticket 14' may serve as the contemplated identification/information 28 and/or the writing, design, etc. on the ticket 14' may perform this function.

While the above description relates to exemplary identification/information that may be provided on the object 14,14', it is contemplated that the object 14,14' can bear a wide range of identification/information 28 that relates to at least of a) an event; b) a location; c) an institution; d) a product; e) a service; f) a person; g) an animate object; h) an inanimate object; i) a team; and j) a participant in an event that is directly or indirectly coordinated with, or independent of, the identification/information 26 on the headwear piece 12.

The invention contemplates that each tether 16 may maintain multiple objects 14,14' on a headwear piece 12 at each location to which it attaches. Alternatively, multiple tethers 16, as shown in FIG. 1, can be used to maintain objects 14 at the same or different locations. In FIG. 1, one tether 16 is shown attached to the crown 18, with another tether 16 attached to the rim/bill 20. Additional tethers 16 with associated objects 14 could likewise be utilized with objects 14 of the same or a different nature.

The tether 16 can take a variety of different forms. It is desirable, but not necessary, that, regardless of the form of the tether 16, it be flexible so that the object 14 and headwear piece 12 can be relatively repositioned, as by flexing the tether 16. The tether 16 can also effect what is intended to be a permanent connection or a separable connection.

Figure 4:
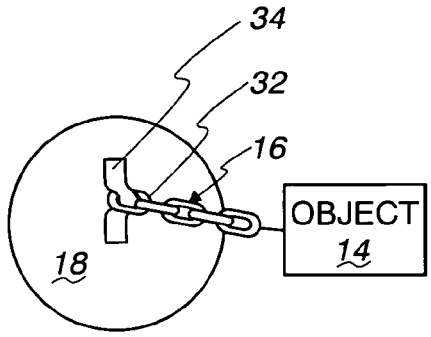
FIG. 4 is a partially schematic, fragmentary, perspective view, showing a part of the headwear piece in FIG. 1 with one form of tether for connecting an object to the headwear piece.

As shown in FIG. 4, one form of the tether 16, for essentially permanent connection, is shown as a chain-type element with joined links 32 extending between the object 14 and the crown 18. In this embodiment, a tab 34 projects through one of the links 32 and is sewn to the crown 18.

Figure 5:
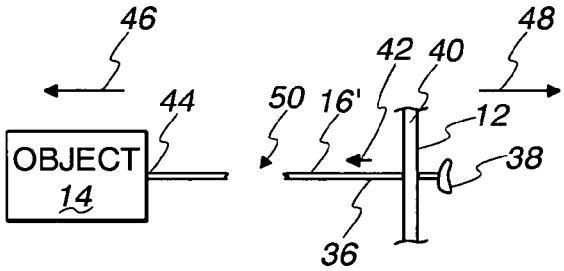
FIG. 5 is a view as in FIG. 4 of another type of tether for connecting an object to the headwear piece in FIG. 1.

Alternatively, as shown in FIG. 5, the tether 16' may be in the nature of a breakable element. More specifically, the tether 16' consists of an elongate, non-metal element 36 that is connected between the object 14 and headwear piece 12. As one example, the elongate element 36 may be made from plastic. One known construction employs a transverse end 38 which can be directed by a conventional tool through a wall 40 on either the crown 18 or rim/bill 20 of the headwear piece 12. Once inserted, the end 38 assumes the configuration shown in FIG. 5, wherein it resists being drawn back through the wall 40, in the direction of the arrow 42. The opposite end 44 of the elongate element 36 may be connected in the same manner, or in a different manner, to the object 14.

The object 14 can be separated from the headwear piece 12 in one of three different manners. By drawing the object 14 and headwear piece 12 oppositely in the direction of arrows 46,48, separation occurs by reason of a) the end 38 being drawn back through the wall 40 in the direction of the arrow 42, b) separation of the end 44 from the object 14, and c) rupture of the elongate element 36, as shown at 50. The rupture occurs under a tensile force applied lengthwise of the elongate element 36. In one form, it is intended that this separation be effected under a relatively "moderate" tensile force that can be applied by the user. The magnitude of this force may be on the order of 1-3 pounds. It is desirable that the tether 16 remain intact to positively hold the headwear piece 12 and object 14 together as a package for transportation and display, yet allow release of the object 14 from the headwear piece 12 under a modest force that can be applied by a user after purchase without any significant inconvenience or discomfort.

Figure 6:
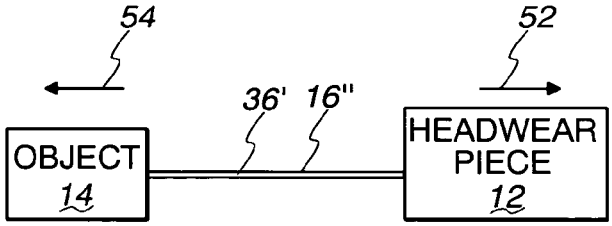
FIG. 6 is a partially schematic representation of another form of tether for connecting an object to the headwear piece in FIG. 1.
Figure 7:
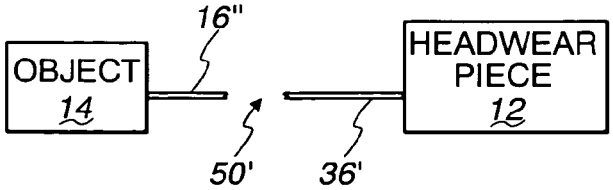
FIG. 7 is a view as in FIG. 6 wherein the object and headwear piece have been moved apart to cause a rupture of the tether.

As shown more generically in FIGS. 6 and 7, the tether 16" may be made from any type of elongate element 36', permanently or semi-permanently attached to the headwear piece 12 and object 14, to rupture under the application of a tensile force produced by moving the headwear piece 12 and object 14 in opposite directions, as indicated by the arrows 52,54, whereby a separation occurs at 50'. Other tethers substantially different than the tethers 16, 16', 16", are contemplated, so long as the tethers are capable of maintaining the object 14 together with the headwear piece 12.

Figure 8:
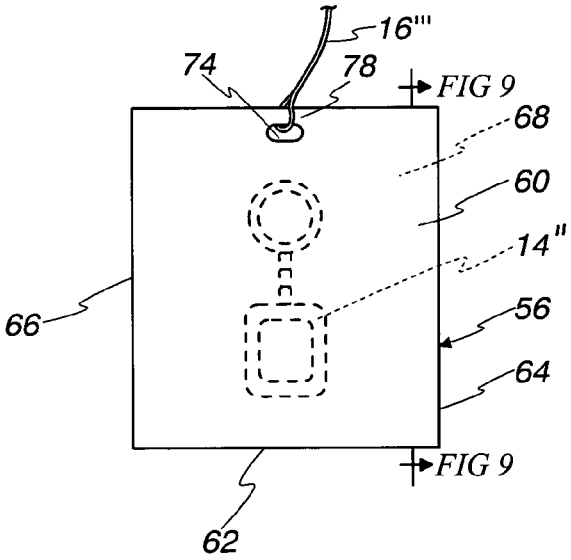
FIG. 8 is an elevation view of a container for an object with a portion of a tether for maintaining the object therein on the headwear piece.
Figure 9:
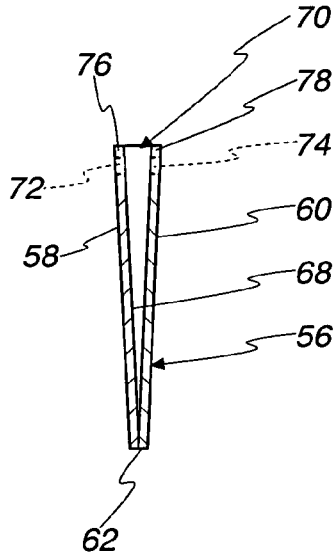
FIG. 9 is a cross-sectional view of the container taken along 9-9 of FIG. 8.

As shown in FIGS. 8 and 9, a container 56 may be utilized to hold the object 14", in this case shown as a key ring, with the container 56 in turn maintained on the headwear piece by the tether 16'". The container 56 may take a variety of different forms, such as a pouch, or the like. In this embodiment, the container 56 is in the form of an envelope with spaced clear or opaque walls 58,60, suitably joined at a bottom edge 62 and spaced side edges 64,66 so that a receptacle 68 for the object is defined between the walls 58,60. An access opening 70 is provided at the top of the container 56 and is in communication with the receptacle 68, thereby allowing the object 14 to be directed thereinto and removed therefrom. The walls 58,60 have openings 72,74, respectively, through which the tether 16 can be directed so as to cinch the wall portions 76,78 to thereby close the access opening 70.

Figure 10:
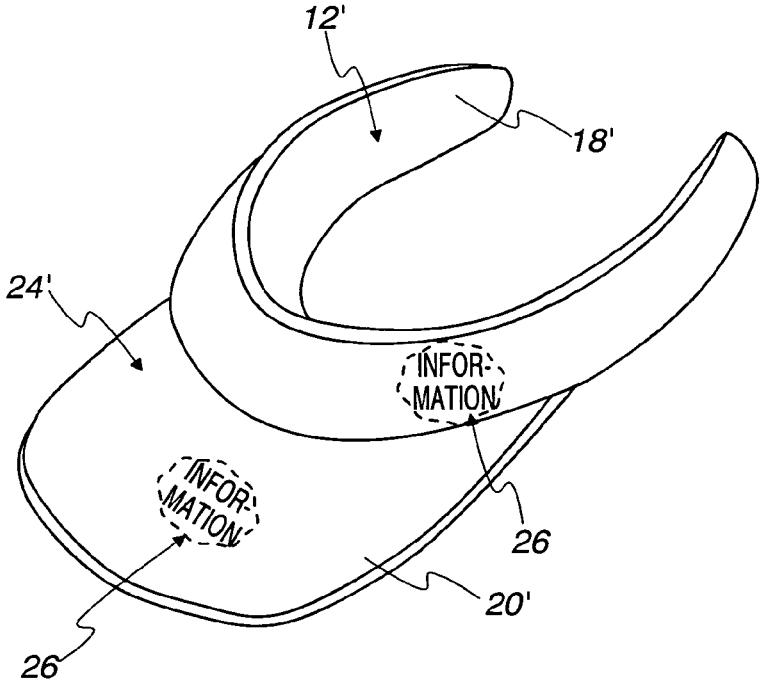
FIG. 10 is a perspective view of another form of headwear piece with which the present invention is practiced.
Figure 11:
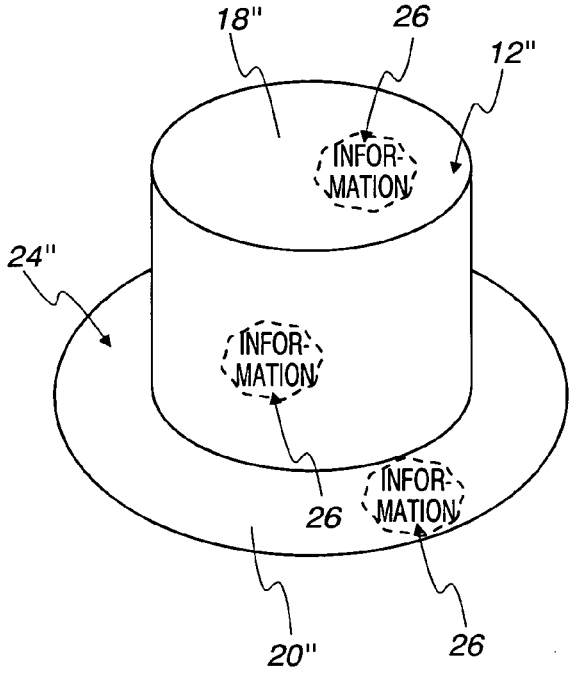
FIG. 11 is a perspective view of another form of headwear piece with which the invention is practiced.
Figure 12:
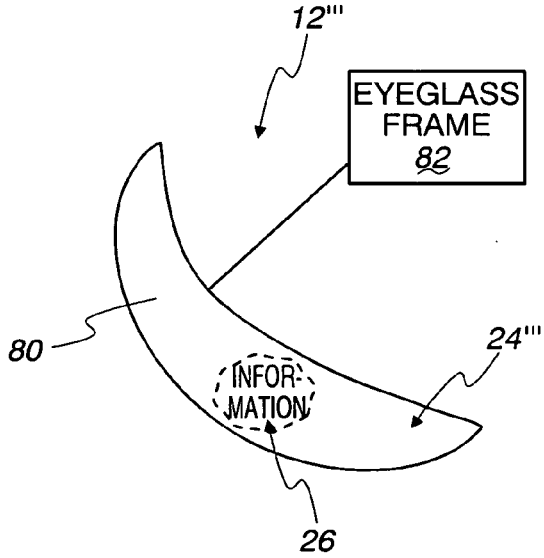
FIG. 12 is a perspective view of still another form of headwear piece with which the present invention is practiced.

The invention contemplates tethering objects 14,14', 14" to other types of headwear, as shown in FIGS. 10-12. In FIG. 10, a headwear piece at 12' is shown in the form of a visor with a crown 18' that extends only partially around a wearer's head. The crown 18' has an associated rim/bill 20'. The identification/information 26 is applied to an exposed outer surface 24' in the same manner as for the headwear piece 12.

In FIG. 11, a headwear piece 12" has an inverted, cup-shaped crown 18" with a continuous rim 20" extending fully around the circumference of the crown 18". The identification/information 26 is applied on an exposed outer surface 24" defined by the crown 12" and rim 20".

In FIG. 12, a headwear piece 12'" is shown consisting of a flap 80, conventionally attached to an eyeglass frame 82 so that the flap 80 and eyeglass frame 82 effectively define a functional equivalent to the aforementioned crowns 12,12', 12". Identification/information 26 is applied to the exposed outer surface 24'" of the flap 80.

Figure 13:
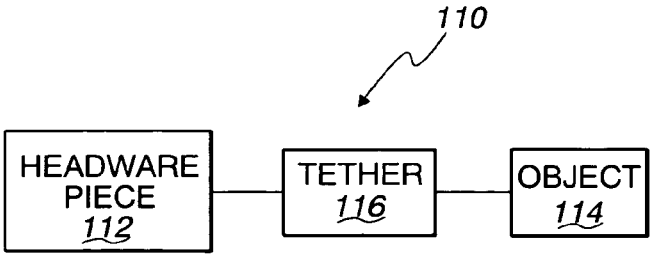
FIG. 13 is a schematic representation of one category of kit/package according to the present invention.

As described above, and shown generically in FIG. 13, it is contemplated that a kit/package 110, according to the invention, may include any type of headwear piece 112. The object 114 can be virtually any type of utilitarian or nonutilitarian object which, in a preferred form, is substantially smaller in size than the associated headwear 112. The tether 116 may be of a type to effect a permanent or releasable connection between the headwear piece 112 and object 114. The tether 116 is preferably flexible, but need not be.

Figure 14:
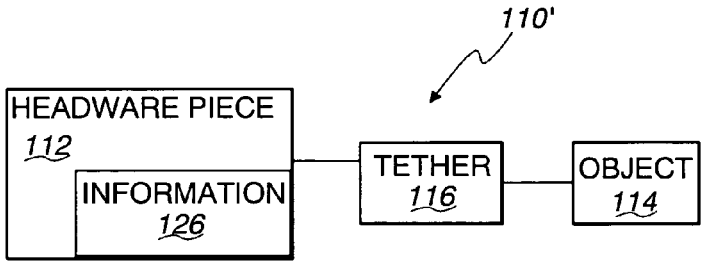
FIG. 14 is a view as in FIG. 13 of another category of kit/package according to the present invention.

As shown in FIG. 14, one category of the kit/package 110' includes the aforementioned headwear piece 112, object 114, and tether 116. In this embodiment, the identification/information 126 is provided only on the headwear piece 112, with no requirement of any corresponding or related identification/information on the object 114.

Figure 15:
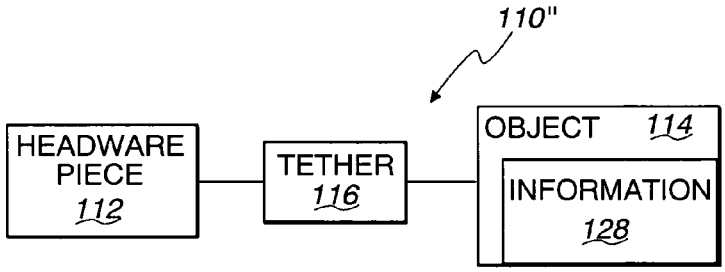
FIG. 15 is a schematic representation of another category of kit/package according to the present invention.

In FIG. 15, a category of kit/package 110" is shown with the aforementioned headwear piece 112, object 114, and tether 116. The identification/information 128 is provided on the object 114, without any requirement of any related or unrelated identification/information on the headwear piece 112.

Figure 16:
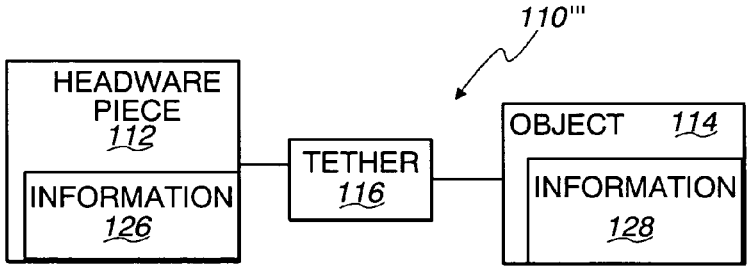
FIG. 16 is a schematic representation of still another form of kit/package according to present invention.

In FIG. 16, a further category of kit/package 110'" is shown with the aforementioned headwear piece 112, object 114 and tether 116. In this case, identification/information 126 is provided on the headwear piece 112, with identification/information 128 applied to the object 114. At least one object 114 has an identification thereon that relates to at least one of: a) an event; b) a location; c) an institution; d) a product; e) a service; f) a person; g) an animate object; h) an inanimate object; i) a team; and j) a participant in an event. The tether maintains the at least one object 114 on the headwear piece 112. The identification/information 126,128 on the headwear piece 112 and object 114 preferably is coordinated, but need not be related, or may be indirectly related.

Figure 17:
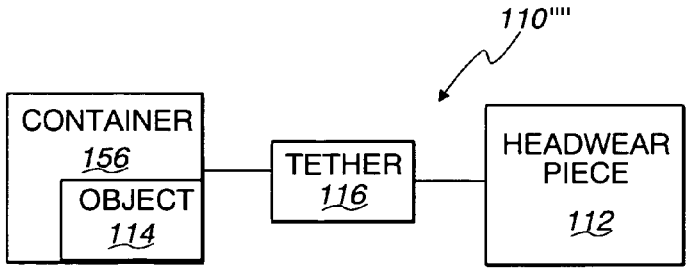
FIG. 17 is a schematic representation of yet another category of kit/package, according to the present invention.

In FIG. 17, a further category of kit/package is shown at 110"" In this embodiment, a container 156 is utilized for the object 114 which is connected to the headwear piece 112 using the aforementioned tether 116.

While the invention has been described with particular reference to the drawings, it should be understood that various modifications could be made without departing from the spirit and scope of the present invention.

The invention claimed is:

1. In combination:

(a) a headwear piece comprising a crown with a surface for engaging a wearer's head to maintain the headwear piece in an operative position on the wearer's head and an exposed external surface;

(b) at least one object that has an identification thereon that relates to at least one of: a) an event; b) a location; c) an institution; d) a product; e) a service; f) a person; g) an animate object; h) an inanimate object; i) a team; and j) a participant in an event; wherein the at least one object comprises either a functional item specifically made to perform a clearly identifiable and intended function independently of the headwear piece that is not related to the headwear piece and that can be used by a wearer to assist in the performance of a task by a wearer or a replica of a functional item specifically made to perform a clearly identifiable function independently of the headwear piece that is not related to the headwear piece; and (c) a tether through which the at least one object is maintained on the headwear piece, wherein there is an identification, independent of the at least one object and applied directly on the exposed external surface on the headwear piece, that is coordinated with the identification on the at least one object, the identification on the at least one object separate from the identification applied directly on the exposed external surface on the headwear piece, wherein the at least one object comprises a key chain separate from the tether.

2. In combination:

(a) a headwear piece comprising a crown with a surface for engaging a wearer's head to maintain the headwear piece in an operative position on the wearer's head and an exposed external surface;

(b) at least one object that has an identification thereon that relates to at least one of: a) an event; b) a location; c) an institution; d) a product; e) a service; f) a person; g) an animate object; h) an inanimate object; i) a team; and j) a participant in an event; wherein the at least one object comprises either a functional item specifically made to perform a clearly identifiable and intended function independently of the headwear piece that is not related to the headwear piece and that can be used by a wearer to assist in the performance of a task by a wearer or a replica of a functional item specifically made to perform a clearly identifiable function independently of the headwear piece that is not related to the headwear piece; and (c) a tether through which the at least one object is maintained on the headwear piece, wherein there is an identification, independent of the at least one object and applied directly on the exposed external surface on the headwear piece, that is coordinated with the identification on the at least one object, the identification on the at least one object separate from the identification applied directly on the exposed external surface on the headwear piece, the tether is designed to permanently maintain the at least one object on the headwear piece.

3. In combination:

(a) a headwear piece comprising a crown with a surface for engaging a wearer's head to maintain the headwear piece in an operative position on the wearer's head and an exposed external surface;

(b) at least one object that is specifically designed to perform a clearly identifiable function independently of the headwear piece that is not related to the construction of the headwear piece and that can be used by a wearer to assist in the performance of a task or is a replica of an object that is specifically designed to perform a clearly identifiable and intended function independently of the headwear piece that is not related to the construction of the headwear piece;

(c) a tether through which the at least one object is maintained on the headwear piece; and coordinated identifications separately on the headwear piece and at least one object that relate to at least one of: a) an event; b) a location; c) an institution; d) a product; e) a service; f) a person; g) an animate object; h) an inanimate object; i) a team; and j) a participant in an event, the identification on the headwear piece applied directly on the exposed external surface, wherein the at least one object comprises a key chain.

* * * * *